US007510406B2

(12) United States Patent
Dong

(10) Patent No.: US 7,510,406 B2
(45) Date of Patent: Mar. 31, 2009

(54) RETAINING DEVICE FOR RETAINING ELECTRICAL CONNECTOR ON PERIPHERAL ELECTRONIC APPARATUS

(75) Inventor: Lun-Tao Dong, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/824,747

(22) Filed: Jul. 2, 2007

(65) Prior Publication Data

US 2008/0003859 A1 Jan. 3, 2008

(30) Foreign Application Priority Data

Jun. 30, 2006 (CN) ..... 2006 2 0074605

(51) Int. Cl.
*H01R 12/00* (2006.01)

(52) U.S. Cl. ..... 439/79

(58) Field of Classification Search ..... 439/79, 439/80

See application file for complete search history.

(56) References Cited

U.S. PATENT DOCUMENTS

| | | | | |
|---|---|---|---|---|
| 6,159,023 | A * | 12/2000 | Lai | 439/79 |
| 6,595,801 | B1 * | 7/2003 | Gardner et al. | 439/607 |
| 6,733,339 | B2 * | 5/2004 | Casey | 439/607 |
| 6,755,689 | B2 * | 6/2004 | Zhang et al. | 439/607 |
| 7,004,782 | B2 | 2/2006 | Kroenung | |

* cited by examiner

*Primary Examiner*—Phuong K Dinh
(74) *Attorney, Agent, or Firm*—Wei Te Chung

(57) ABSTRACT

A retaining device (1) adapted for retaining an electrical connector (2) on a peripheral electronic apparatus, includes a retaining member (10) and a locking member (13). The retaining member includes a board-shaped base section and a retention section (11) bending from an edge of the base section. The base section includes a retaining portion engaging with the connector, and the retention section includes a through-hole (110) thereon to engage with the locking member.

16 Claims, 6 Drawing Sheets

RETAINING DEVICE FOR RETAINING ELECTRICAL CONNECTOR ON PERIPHERAL ELECTRONIC APPARATUS

BACKGROUND OF THE INVENTION

1. Field of the invention

The present invention relates to a retaining device, and more particularly to a retaining device for steadily retaining an electrical connector on a peripheral electronic apparatus.

2. Description of Related Arts

Referring to FIG. 1, a conventional electrical connector 4 usually used as an input/output is connected on a printed circuit board (PCB, not shown) by its soldering pads 41 and legs 42. And then the electrical connector 4 on the PCB is assembled to an electronic apparatus such as personal digital assistant (PDA). However, the electrical connector 4 will be loose from the PCB since the connector continually being connected or disconnected with a complementary connector.

Therefore, an improved invention is desired to overcome the disadvantages of the prior arts.

SUMMARY OF THE INVENTION

The object of the present invention is to provide a retaining device with simple configuration.

Another object of the present invention is to provide an electrical connector with a retaining device steadily retained on a peripheral electronic apparatus.

In order to achieve above-mentioned objects, a retaining device comprises a retaining member and a locking member. The retaining member comprises a board-shaped base section and a retention section bending from an edge of the base section. The base section comprises a retaining portion, and the retention section comprises a through-hole thereon to engage with the locking member.

Other objects, advantages and novel features of the invention will become more apparent from the following detailed description of the present embodiment when taken in conjunction with the accompanying drawings.

DETAILED DESCRIPTION OF THE INVENTION

Figure 1:
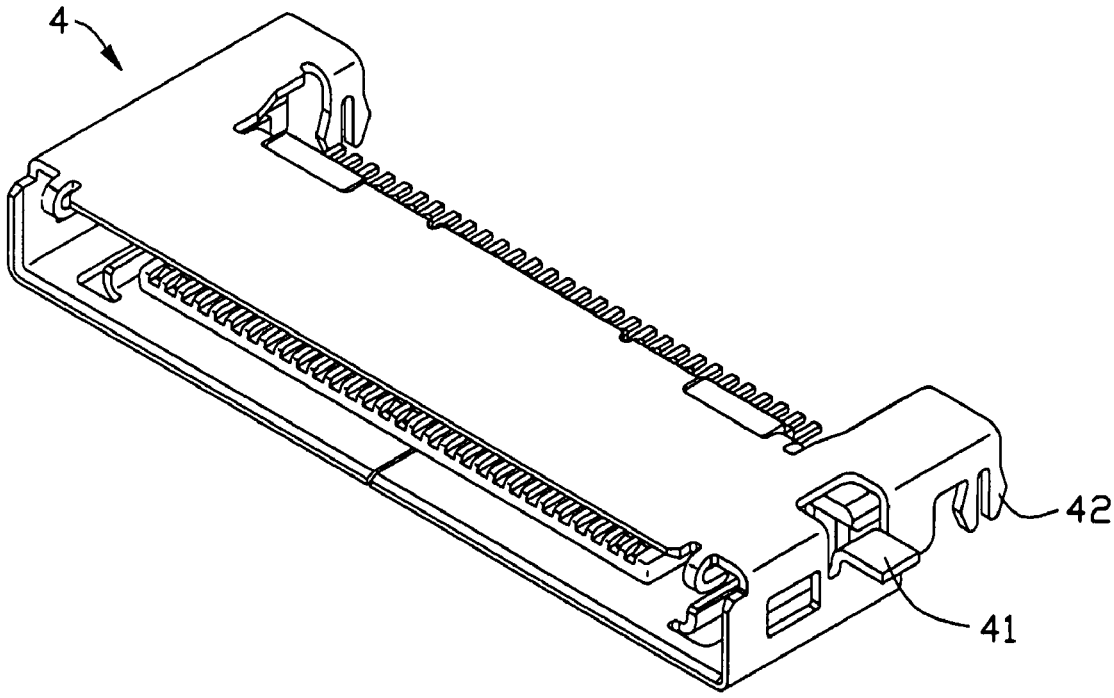
FIG. 1 (PRIOR ART)
FIG. 1 is a perspective view of a conventional electrical connector.

Reference will now be made to the drawing figures to describe the present invention in detail.

Figure 2:
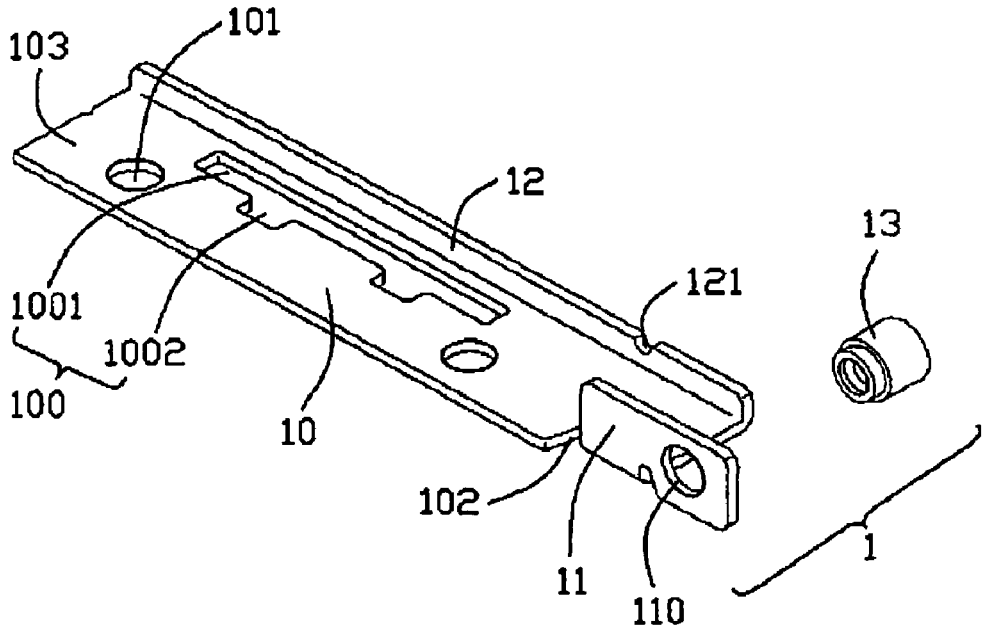
FIG. 2 is a perspective view of a retaining device of the present invention.

With reference to FIG. 2, a retaining device 1 of the present invention comprises a board-shaped retaining member 10 and a looking member 13. The retaining member 10 has a rectangular base section 103. A side board 12 vertically extends from one edge (back edge) of the base section 103 along a lengthwise direction of the base section 103. An indentation 102 is defined at another edge (front edge) of the base section

103 and extends vertically to the side board 12, and a retention section 11 vertically bends from an end of the base section 103 and parallel to the side board 12. The indentation 102 will increase the spring of the retention section 11.

There is a slot 100 defined along the lengthwise direction of the base section. The slot 100 comprises a first portion 1001 and a pair of second portions 1002 vertical to the first portion 1001. A pair of through holes 101 in each side of the slot 100 lies near the front edge of the base section. A notch 121 is defined on the top edge of the side board 12. The retention section 11 defines a through-hole 110 thereon to engage with the locking member 13.

Figure 4:
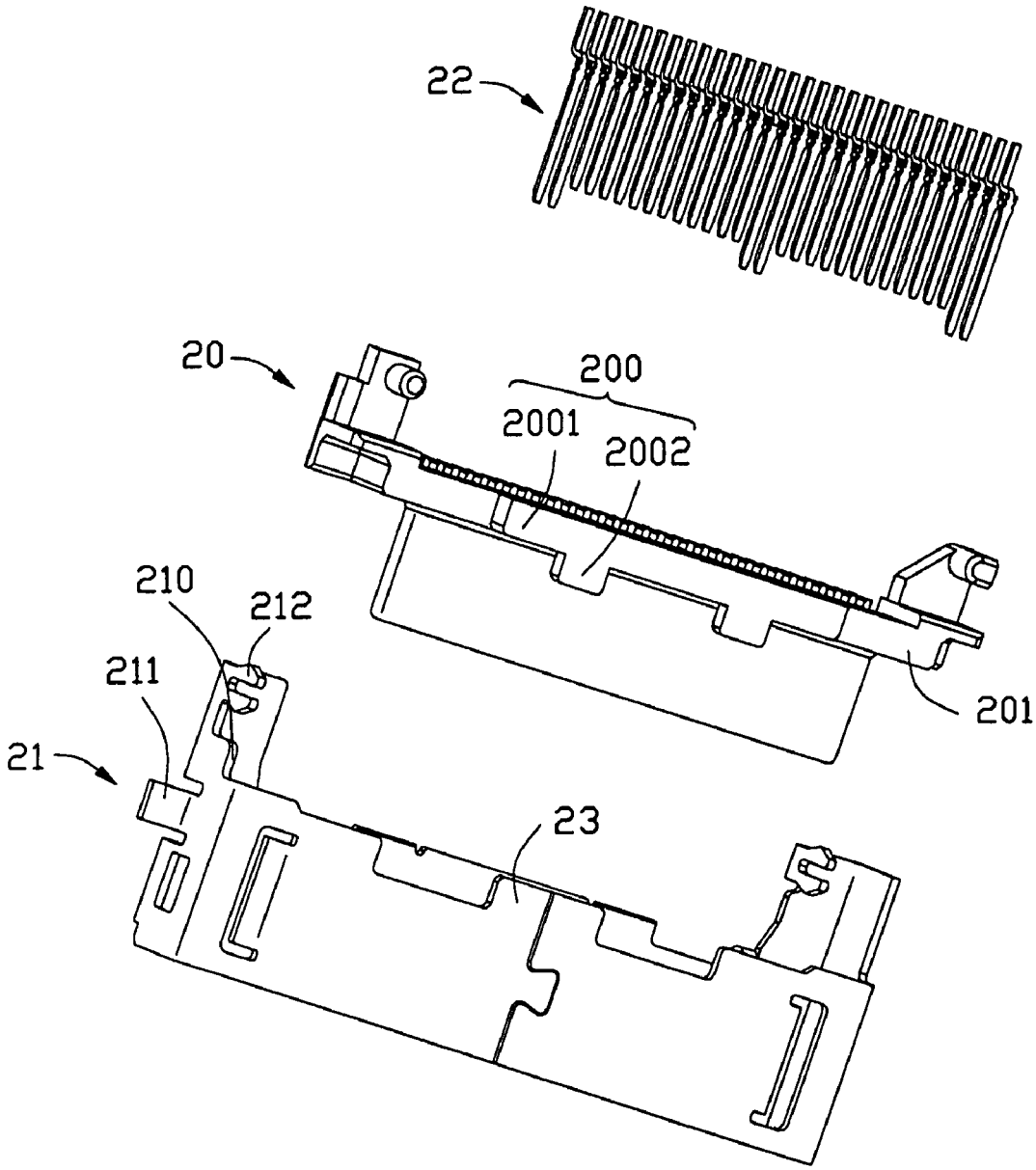
FIG. 4 is an exploded view of the electrical connector shown in FIG. 3.

With reference to FIG. 4, the electrical connector 2 comprises an insulating housing 20, a plurality of contacts 22 received in the insulating housing and a shell 21. The insulating housing 20 includes a lengthways base portion 201. A rib 200 is defined on the bottom of the base portion 201 along the lengthways direction and comprises two portions, a first portion 2001 and a pair of second portions 2002 vertical to the first portion 2001. The shell 21 surrounds the insulating housing 20 with an outspread portion 23 clamped between the pair of second portions 2002, and has a soldering leg 211 and a pair of board-locking legs 212, which both used to solder the electrical connector 2 on the circuit board.

Figure 3:
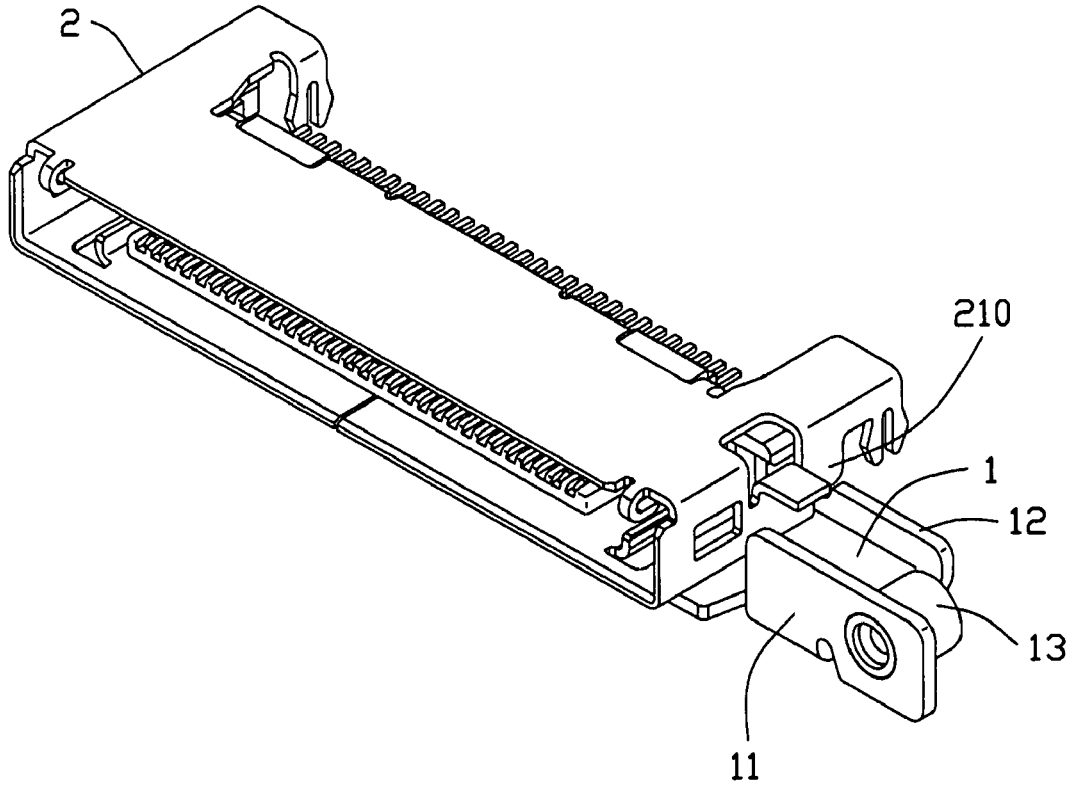
FIG. 3 is a perspective view of the retaining device assembled with an electrical connector.
Figure 5:
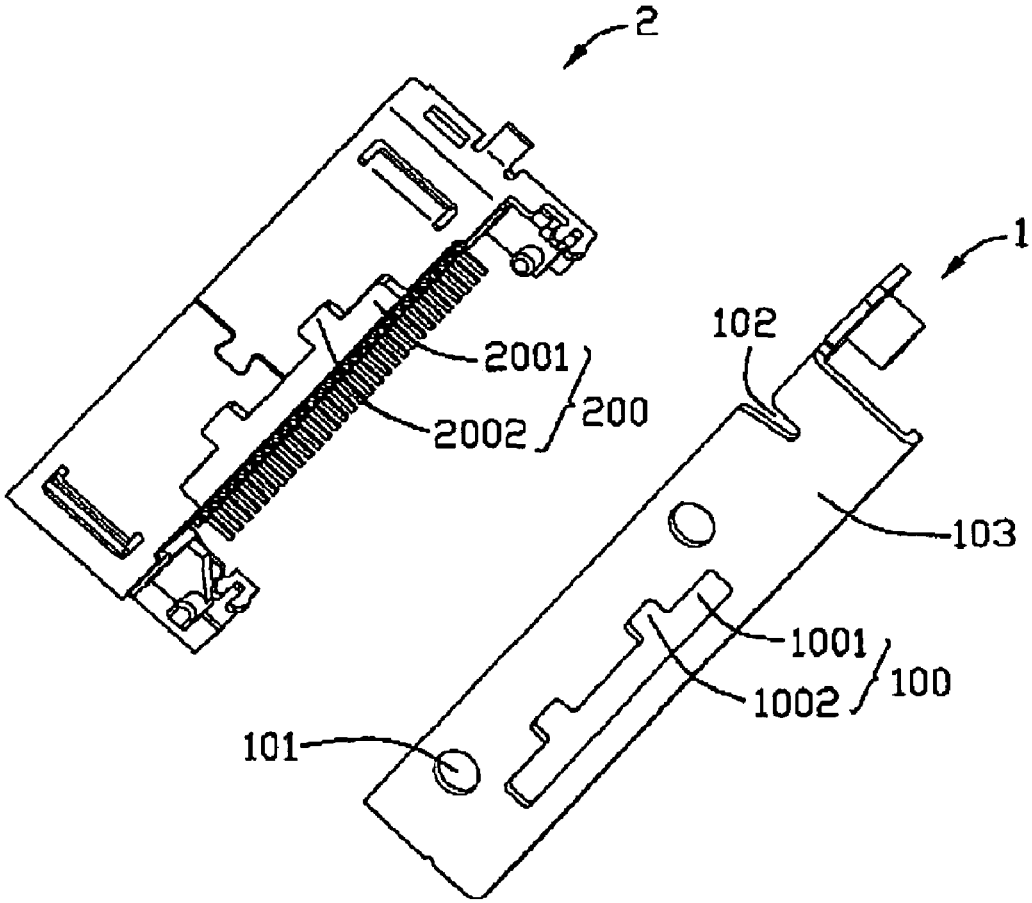
FIG. 5 is an un-assembled perspective view of the retaining device and the connector from a bottom side.
Figure 6:
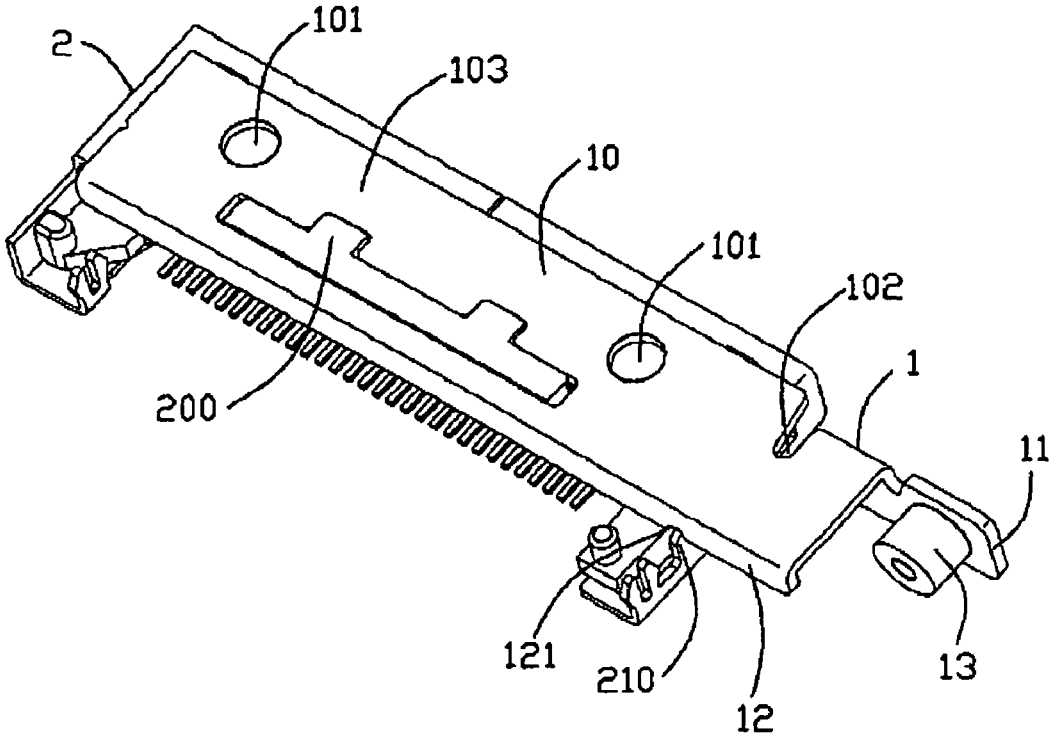
FIG. 6 is an assembled perspective view of the retaining device and the connector of FIG. 5.

With reference to FIG. 3, FIGS. 5 and 6, the retaining device 1 is used to fasten an electrical connector 2 to an electronic apparatus (not shown). After the connector 2 is mounted on a circuit board (not shown), the retaining device 1 is set on the bottom of the connector 2, with the rib 200 set in the slot 100. The first portion 2001 of the rib 200 engages with the first portion 1001 of the slot 100, the second portions 2002 engages with the second portions 1002. And the retaining device 1 is soldered on the shell by the through holes 101. The side board 12 is put against the backside of the base portion 201 to prevent the electrical connector 2 from moving backwards from the retaining device 1. The notch 121 engages with a sidewall 210 of the shell 21. The through holes 101 sad the slot 100 are both used to fasten the retaining device 1 to the electrical connector 2, which both named as a retaining portion. The locking member 13 is riveted on the retention section 11 through the through-hole 110. And then bolt (not shown) is twist into a screw of the locking member 13 to fasten the retaining device 1 on the peripheral electronic apparatus.

However, the disclosure is illustrative only, changes may be made in detail, especially in matter of shape, size, and arrangement of parts within the principles of the invention.

What is claimed is:

1. A retaining device for retaining an electrical connector on an electrical apparatus, and which connector including an insulating housing and a shell surround the insulating housing comprising: a retaining member comprising a board-shaped base section to be retained on a bottom of the electrical connector, and a retention section bending upwards from an edge and having a hole; a locking member adapted for locking the retention section to the electronic apparatus through the hole; wherein the retention section is located beyond and adjacent to one end of the connector; and the base section attaching to the shell and defines through holes by which the retaining device is soldered on the shell.

2. The retaining device as described in claim 1, wherein the base section defines a slot.

3. The retaining device as described in claim 2, wherein the slot comprises a first portion along a lengthwise direction of the base section and at least one second portion vertical to the first portion.

4. The retaining device as described in claim 1, wherein a side board vertically extends from another edge opposite to said edge of the base section along a lengthwise direction of the base section to prevent the electrical connector from moving backwards.

5. The retaining device as described in claim 4, wherein a notch is defined on a top edge of the side board.

6. The retaining device as described in claim 1, wherein the retention section is adjacent to one end of the base section and vertical to the base section.

7. The retaining device as described in claim 1, wherein an indentation is defined on the base section near a position where the retention section extends.

8. The retaining device as described in claim 1, wherein the locking member comprises screw thereon.

9. The retaining device as described in claim 1, wherein the base section defines a pair of through holes for being soldered with.

10. An electrical connector assembly for being retained on an electronic apparatus, comprising:

an electrical connector with a plurality of contacts therein, having opposite larger faces;

a retaining device only assembled on one of said larger faces in a vertical direction comprising a one-piece retaining member and a locking member;

wherein the retaining member comprises a base section retained on said one larger face and a retention section perpendicular to the base section and section and parallel to a mating face of the connector for mating with a mating connector, wherein the electrical connector comprises an insulating housing and a shell surrounding the insulating housing, the base section attaching to the shell defines through holes by which the retaining device is soldered on the shell.

11. The electrical connector assembly as described in claim 10, wherein the electrical connector comprises an insulating housing, and the insulating housing comprises a rib on one side thereof along a lengthwise thereof and the base section defines a slot to engage with the rib.

12. The electrical connector assembly as described in claim 10, wherein a side board extends from one edge of the base section along a lengthwise direction of the base section to adjacent against the backside of the insulating housing.

13. The electrical connector assembly as described in claim 12, wherein the side board defines a notch thereon to engage with a sidewall of the shell.

14. An electrical connector assembly, comprising:

an insulative housing; a plurality of contacts disposed in the housing; a metallic shell enclosing said housing with a mating port thereof, and defining a mating direction and a longitudinal direction perpendicular to the mating direction; a discrete metallic retaining device positioned upon the shell and including a retaining section located at a longitudinal end of said shell outside of the housing in said longitudinal direction, the retention section is perpendicular to the mating direction; wherein the insulating housing includes a shell surrounding the insulating housing, a base section attaching to the shell defines through holes by which the retaining device is soldered on the shell.

15. The electrical connector as claimed in claim 14, wherein the retaining device includes a base from which the retention section extends, and said base defines a dimension, along said longitudinal direction similar, similar to a longitudinal dimension of the shell.

16. The electrical connector as claimed in claim 14, wherein the retaining device includes a base from which the retention section extends, sand said base is attached to at least one of said housing and said shell under said mating port.

* * * * *